United States Patent [19]

Raymond

[11] 4,155,577

[45] May 22, 1979

[54] SECURITY DEVICE

[76] Inventor: Edward L. Raymond, 2210 Sheridan Ave. North, Minneapolis, Minn. 55411

[21] Appl. No.: 914,419

[22] Filed: Jun. 12, 1978

[51] Int. Cl.[2] ..... E05C 17/36

[52] U.S. Cl. ..... 292/264; 70/49

[58] Field of Search ..... 292/264, 263, 262, DIG. 16; 70/49; 24/73 A; 248/499, 505, 507

[56] References Cited

U.S. PATENT DOCUMENTS

| | | | |
|---|---|---|---|
| 186,319 | 1/1877 | Dietz | 292/264 |
| 878,607 | 2/1908 | Cairns | 292/264 |
| 890,518 | 6/1908 | Kleidmann | 292/264 |
| 2,367,039 | 1/1945 | Lally et al. | 85/50 R |

FOREIGN PATENT DOCUMENTS

| | | | |
|---|---|---|---|
| 1016214 | 8/1977 | Canada | 292/264 |

*Primary Examiner*—J. Franklin Foss

*Attorney, Agent, or Firm*—Burd, Braddock & Bartz

[57] ABSTRACT

A security device used to check a door in a partially open position to prevent unauthorized entrance into a room having a doorway normally closed by the door. The security device has an anchor assembly, including a lag bolt secured to the door frame adjacent the door knob when the door is in a closed position. The lag bolt has a body carrying a head located outwardly from the frame. A rigid ring having an inside diameter slightly greater than the diameter of the door knob is attached to the anchor assembly with a link chain. The link chain has an anchor link surrounding the body of the lag screw and a ring link extended through the ring. A spacer sleeve surrounding the body of the anchor assembly holds the anchor link adjacent the head spaced from the frame and casing of the doorway. The intermediate chain links connecting the anchor link with the ring link are surrounded with a sleeve. The sleeve is located in a tight engagement with the intermediate links and allows for free movement of the anchor link and ring link.

8 Claims, 6 Drawing Figures

SECURITY DEVICE

BACKGROUND OF INVENTION

Security chains and dead bolts are used in conjunction with the conventional door locks to maintain the doors in a closed secured position. A security chain allows the door to be partially open without providing access to the room or dwelling. Chain locks are normally anchored to the door frame adjacent the door knob and have a ring or loop adapted to fit over the door knob. The chains are positioned close to the woodwork and trim of the door casing so that in use both the trim and the door become marred with scratches and indentations.

SUMMARY OF INVENTION

The invention is directed to a security device for a closure means such as a door or panel to prevent unauthorized access into a location, such as a room or dwelling. The security device is used for a door hinged to a door frame. The door carries a conventional door lock, such as a key operated door lock, that cooperates with a lock plate attached to the door frame. The door lock has an enlarged inside door knob and a neck spacing the door knob from the door. An anchor assembly is secured to the door frame adjacent the door knob when the door is closed. The anchor assembly has a body extended outwardly from the door frame terminating in a head. Rigid ring means having an inside diameter slightly greater than the diameter of the door knob are used to releasably connect the security device to the door by placing the ring means over the door knob about the stem. Link means connect the ring to the body of the anchor assembly. The link means has an extended length that allows the ring means to pass over the door knob when the door is in the closed position. An anchor link on the link means surrounds the body and can rotate on the body. A ring link extends through the ring means. The anchor link and ring link are connected with means surrounded by a sleeve. The sleeve is located in tight engagement with the means connecting the anchor link and ring link and allows for free movement of both the anchor and ring links. A spacer means surrounds the body of the anchor assembly and spaces the anchor link from the door trim to minimize marring of the door trim by the anchor link and the sleeve.

IN THE DRAWINGS

DETAILED DESCRIPTION OF PREFERRED EMBODIMENT

Figure 1:
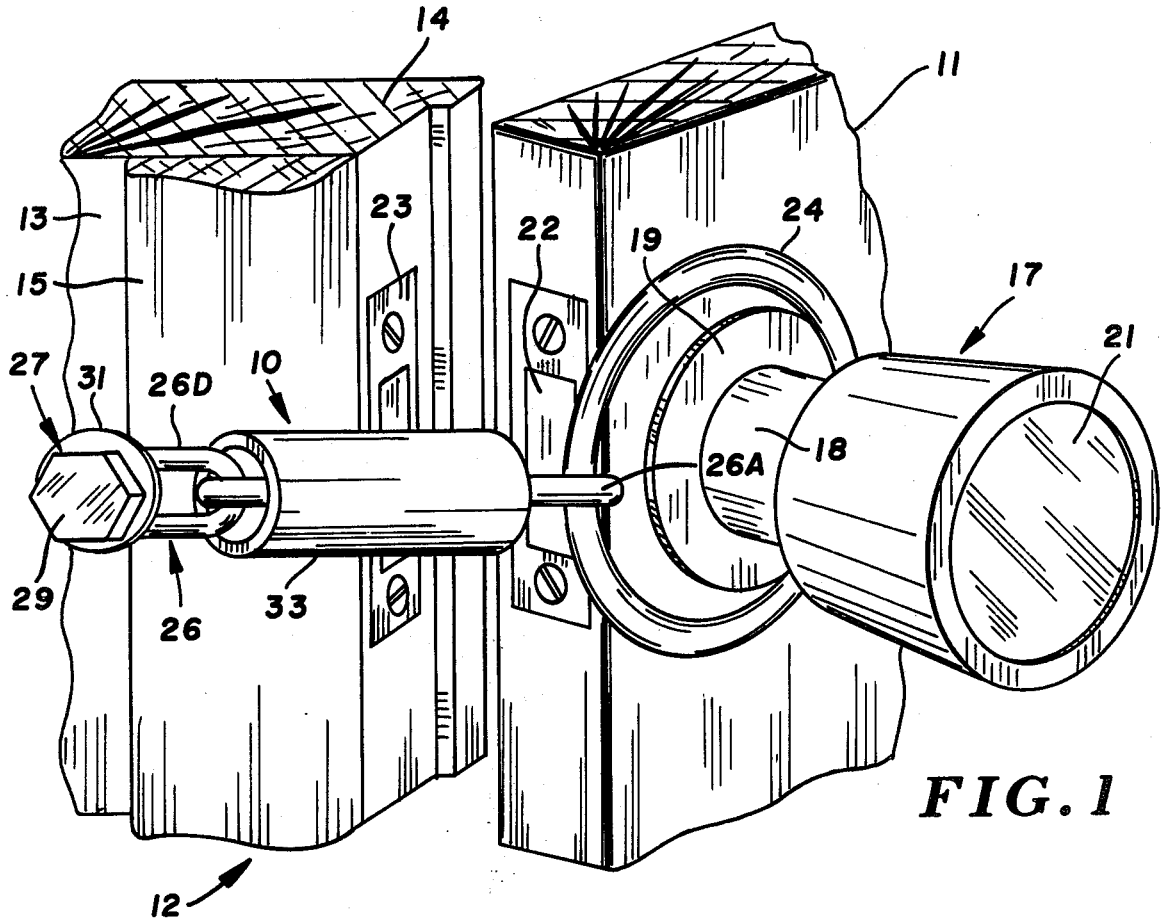
FIG. 1 is a fragmentary perspective view of the lock section of a door held in a secured position by the door security device of the invention.
Figure 2:
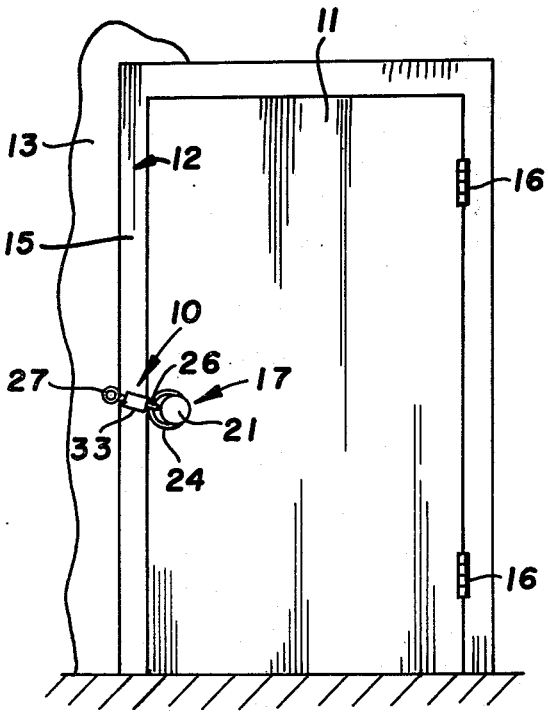
FIG. 2 is a plan view of a closed door hinged to a door frame associated with the door security device in the lock position.
Figure 3:
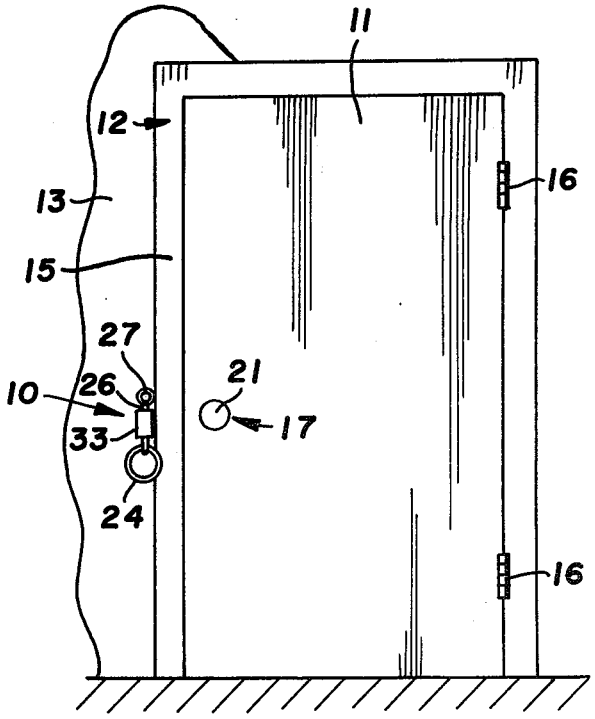
FIG. 3 is a view similar to FIG. 2 showing the door security device in the release position.
Figure 4:
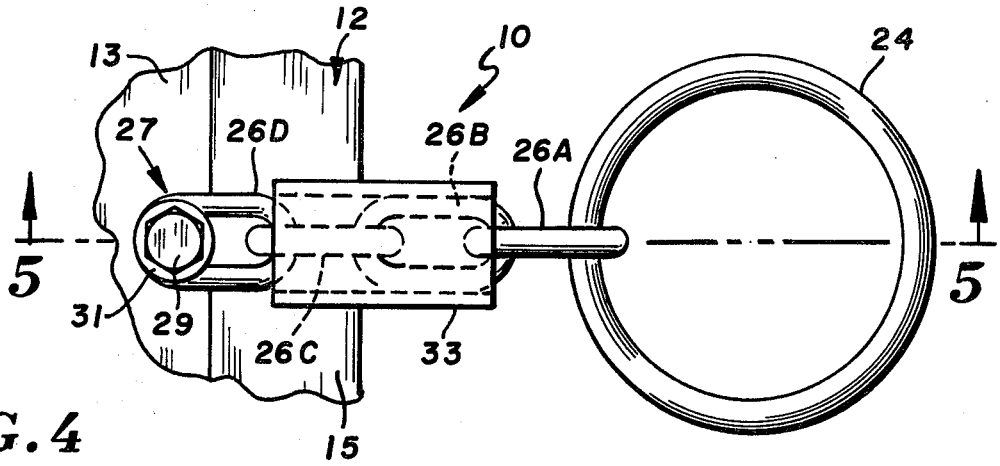
FIG. 4 is a top plan view of the door security device.

Referring to FIGS. 1–3, there is shown a door security device of the invention indicated generally at 10 associated with a closure means 11, such as a door or panel. The following description is directed to a closure means in the form of a door for closing an entrance into a room of a house or building. Other types of closure means, such as panels and sliding drawers, can be used in association with the door security device of the invention to retain the closure means in a secured position preventing unauthorized opening of the door.

Door 11 is an upright flat panel located in a doorway surrounded by a door frame or casing indicated generally at 12. An upright wall 13 surrounds frame 12. Frame 12 has studs or framework 14, as one or more 2×4's, providing support for door 11. Door trim 15 attached to studs 14 extends around the sides and top of frame 12 adjacent door 11. A pair of hinges 16 pivotally mount the inside edge of door 11 to frame 12 for swinging movement about a generally upright axis to open and closed positions. A conventional door lock indicated generally at 17, as a key operated lock, is mounted on the mid-section of the outer edge of door 11. Door lock 17 has a horizontal stem or neck 18 surrounded by a flat ring 19 that is flush with the inside surface of door 11. An enlarged knob 21 is attached to the outer end of neck 18. A movable latch 22 is operatively connected to neck 18 and knob 21 so that on rotation of the knob 21, latch 22 will move to an in position, thereby allowing door 11 to swing to an open position. Latch 21 cooperates with a lock or latch plate 23 on door frame 12 to hold door 11 in a closed locked position. Door lock 17 is a conventional locking assembly used to releasably hold door 11 in a closed position.

Door security device 10 has a rigid circular ring 24. Ring 24 has an inside diameter that is slightly larger than the outside diameter of knob 21, thereby allowing the ring 24 to slip over knob 21, as shown in FIG. 1. When the ring 24 is in the restraining position on door lock 17 it surrounds neck 18. Ring 24 is a rigid metal ring, as a steel ring, which does not deflect or deform when subjected to heavy forces. Ring 24 is connected to an anchor assembly indicated generally at 24 with a link means indicated generally at 26. Link means 26 is a four-link metal chain that is articuately connected to ring 24 and movably connected to anchor assembly 27. Link 26 has elongated elliptical type rigid metal links 26A, 26B, 26C, and 26D. Ring link 26A fits through the hole in ring 24 whereby ring 24 can pivot with respect to ring link 28A and rotate about its central axis. Anchor link 26 fits around anchor assembly 27 allowing anchor link 26 to have limited lateral movement and free rotational movement. Links 26A–26D are connected in series to form an elongated four-link chain.

Figure 5:
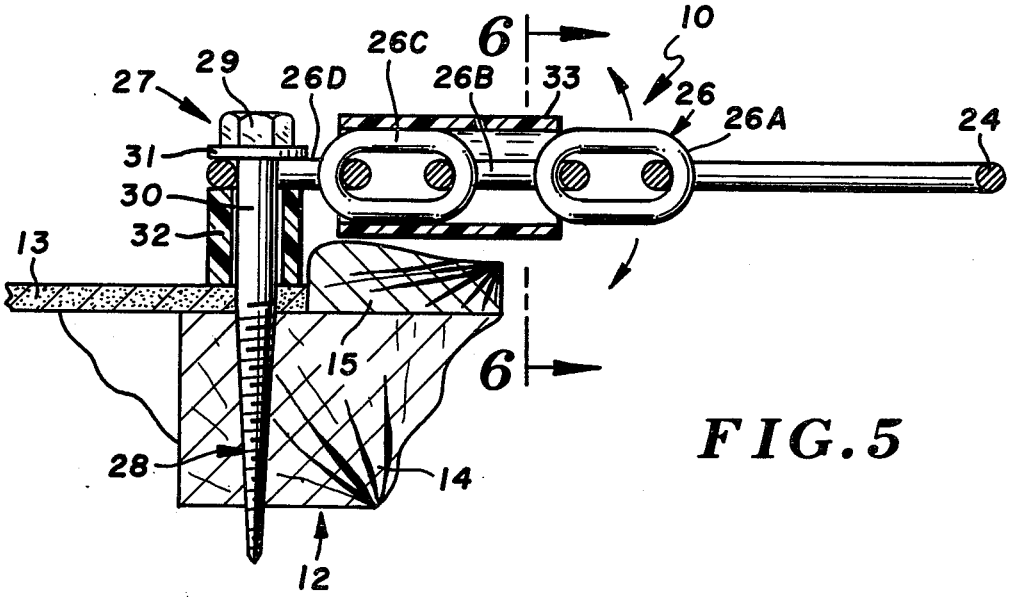
FIG. 5 is a cross sectional view taken along the line 5—5 of FIG. 4.

Anchor assembly 27 includes a long lag screw 28 having an outer head 29. Preferably, lag screw 28 is a 5/16–4" lag screw. Anchor link 26D is spaced from head 29 with an annular flat washer 31. Lag screw 28 has a cylindrical member or body 30 projected outwardly from frame 12. As shown in FIG. 5, the inner end of body 30 is turned into framework 14 to securely mount lag screw 28 in a fixed position in framework 14.

Anchor link 26B is spaced outwardly from trim 15 with a spacer sleeve bushing or cylindrical member 32 surrounding body 30. Sleeve 32 has an inside diameter larger than the diameter body 30 so that sleeve 32 can rotate on body 30. Sleeve 32 can be a plastic tube. The inner end of spacer sleeve 32 bears against wall 13. The outer end of spacer sleeve 32 holds anchor link 26 adjacent the washer 31. Sleeve 32 can be a plastic bushing having an outside diameter of 1.5 cm and a length of 2.5 cm. The plastic material of sleeve 32 is a white or light colored deformable plastic, as polyethylene.

Figure 6:
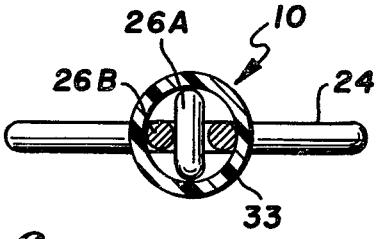
FIG. 6 is a cross sectional view taken along the line 6—6 of FIG. 5.

The links between the anchor link 26D and ring link 26A are held in extended longitudinal positions with elongated cylindrical member or sleeve 33. Sleeve 33 can be a plastic tube. As shown in FIGS. 5 and 6, sleeve 33 surrounds links 26B and 26C. Sleeve 33 is located in a tight fit relationship with respect to the outer sides of the links 26B and 26C. The outer curved end of link 26B is located outwardly of the plane of one outer end of sleeve 33 so that ring link 26A is free to swing or pivot on link 26B. The outer curved end of link 26C extends outwardly from the plane of the opposite or left end of sleeve 33, whereby the anchor link 26D is free to swing relative to link 26C. Sleeve 33 provides a jacket or spacer between the chain links 26C and 26B and the trim 15, whereby the chain links cannot mar or scratch surface of trim 15 and the edge of door 11.

Ring 24 is placed over the knob 21 with door 11 in the closed position. Lag screw 28 is then located next to door trim 15 in a location to prevent or remove the slack in the link chain. When the correct location is found adjacent trim 15, the lag screw location is marked on wall 13. A hole is drilled through wall 13 and into the framework 14. Preferably, a 6 mm or ¼ inch hole 7.5 cm or 3 inches deep is sufficient for a 7 mm or 5/16 inch lag screw. Lag screw 28 is then turned into framework 14 with bushing 32 spacing anchor link 26C from trim 15. Lag screw 28 is turned to a position until anchor link 26D is close to and lightly engages bushing 32. Anchor link 26D is still free to rotate so that the security device 10, as shown in FIG. 3, can hang to a down position so that it doesn't interfere with normal opening and closing of door 11.

In use, ring 24 is placed over door knob 21, as shown in FIGS. 1 and 2. Ring 24 surrounds neck 18. Link means 26 being anchored to door frame 14 with anchor assembly 27 prevents door 11 from being fully opened. Door 11 will open a small amount to take up the slack in the link means necessary to allow ring 24 to be placed over door knob 21 when door 11 is in the closed position. Bushing 32 holds anchor link 26 away from trim 15 and sleeve 33 thereby protecting trim 15 from chain links 26B and 26C. The length of sleeve 33 is such that the link 26A does not contact trim 15.

While there has been shown and described the preferred embodiment of the security device of the invention for a hinged door, it is understood that the changes and modifications can be made in the security device without departing from the invention. For example, the length of the link means 26 can vary allowing the security device to be used with different door constructions. A chain with six links can be used with a back set door. Other chain sizes and chain lengths can be used to connect the anchor with the ring. The anchor can be a toggle bolt or similar anchoring structure. Toggle bolts can be used when the wall structure adjacent the door frame does not have solid backing. The anchor can be a second ring adapted to fit over a second door knob, thereby allowing the security device to be used on french doors. The invention is defined in the following Claims.

The embodiments of the invention in which an exclusive property or privilege is claimed are defined as follows:

1. A security device for a door hinged to a door frame, said door having a lock adapted to be held in a lock plate secured to the door frame to hold the door in a closed position, said lock having an enlarged door knob and a neck spacing the door knob from the door, comprising: an anchor assembly adapted to be secured to the door frame adjacent the door knob when the door is in a closed position, said anchor assembly having a body extended outwardly from the door frame and a head secured to the outer end of the body, rigid ring means having a hole with an inside diameter slightly greater than the diameter of the door knob whereby the ring means can be moved over the door knob onto the stem, link means connected to the ring means and body of the anchor assembly, said link means having a length to allow the ring means to pass over the door knob when the door is in a closed position, and to prevent opening of the door from the closed position to a full open position, said link means further including an anchor link surrounding the body, a ring link extended through the hole of the ring means, and a plurality of chain links connecting the anchor link and ring link, spacer means surrounding the body spacing the anchor link from the door frame and locating the anchor link adjacent the head, and a plastic tube surrounding and located in tight engagement with the plurality of chain links connecting the anchor link and ring link thereby preventing movement of the tube relative to the chain links, said tube allowing substantial free movement of the anchor link and ring link, said spacer means and tube separating the chain links from the door frame to protect the door frame against damage.

2. The device of claim 1 wherein: the body and head of the anchor assembly is a lag screw adapted to be turned into the door frame.

3. The device of claim 2 wherein: the spacer means is a cylindrical member rotatably positioned on the body.

4. The device of claim 1 wherein: the spacer means is a cylindrical member rotatably located around the body.

5. The device of claim 1 wherein: the plurality of chain links comprise a pair of chain links.

6. The device of claim 1 wherein: the body and head of the anchor assembly is a lag screw adapted to be turned into the door frame, said spacer means is a cylindrical member surrounding the body, said plurality of chain links connecting the anchor link and ring link comprise a pair of chain links, and said plastic tube being located in tight engagement with the pair of chain links.

7. The device of claim 1 wherein: the body is a cylindrical member extended laterally from the door frame.

8. The device of claim 7 wherein: the spacer means is a sleeve surrounding the cylindrical member to space anchor link from the door frame.

* * * * *